US007408530B2

(12) United States Patent
Yang

(10) Patent No.: US 7,408,530 B2
(45) Date of Patent: Aug. 5, 2008

(54) APPARATUS AND METHOD OF DRIVING A PLASMA DISPLAY PANEL

(75) Inventor: Hee Chan Yang, Busan (KR)

(73) Assignee: LG Electronics Inc., Seoul (KR)

( * ) Notice: Subject to any disclaimer, the term of this patent is extended or adjusted under 35 U.S.C. 154(b) by 619 days.

(21) Appl. No.: 10/946,196

(22) Filed: Sep. 22, 2004

(65) Prior Publication Data

US 2005/0068263 A1 Mar. 31, 2005

(30) Foreign Application Priority Data

Sep. 26, 2003 (KR) ..... 10-2003-0067000

(51) Int. Cl.
*G09G 3/28* (2006.01)

(52) U.S. Cl. ..... 345/63; 345/60; 345/87; 345/89; 345/690; 345/694; 315/169.1; 315/169.4; 348/671; 348/674

(58) Field of Classification Search ..... 345/63–72, 345/690–694, 88, 89, 204
See application file for complete search history.

(56) References Cited

U.S. PATENT DOCUMENTS 6,624,800 B2 9/2003 Hughes et al.
6,982,704 B2 * 1/2006 Aoki et al. ..... 345/204
7,081,906 B2 * 7/2006 Kim et al. ..... 345/690
2001/0028347 A1 10/2001 Kawahara et al.
2002/0036716 A1 * 3/2002 Ito et al. ..... 348/674
2003/0098824 A1 5/2003 Kang et al.

FOREIGN PATENT DOCUMENTS

| | | |
|---|---|---|
| EP | 1 162 594 | 12/2001 |
| EP | 1 162 594 A2 | 12/2001 |
| EP | 1 164 562 | 12/2001 |
| JP | 2000-259114 | 9/2000 |
| JP | 2002-351392 | 2/2002 |

* cited by examiner

*Primary Examiner*—Richard Hjerpe
*Assistant Examiner*—Jennifer T Nguyen
(74) *Attorney, Agent, or Firm*—Ked & Associates, LLP

(57) ABSTRACT

The present invention relates to to an apparatus for driving a plasma display panel in which an image being full of life is represented through expansion of contrast and the gray level can be expanded, and method for driving the same. According to the present invention, since a gray level of an input data is distributed over the whole gray level region, contrast can be expanded. It is therefore possible to display an image being full of life. Furthermore, if the gray level of the input data is expanded over the whole gray level region, contrast is increased. Moreover, when the gray level region is expanded, an error diffusion unit and/or a dithering unit are/is not used.

12 Claims, 5 Drawing Sheets

APPARATUS AND METHOD OF DRIVING A PLASMA DISPLAY PANEL

CROSS-REFERENCES TO RELATED APPLICATIONS

This Nonprovisional application claims priority under 35 U.S.C. § 119(a) on Patent Application No. 10-2003-0067000 filed in Korea on Sep. 26, 2003, the entire contents of which are hereby incorporated by reference.

BACKGROUND OF THE INVENTION

1. Field of the Invention

The present invention relates to an apparatus for driving a plasma display panel and method thereof, and more particularly, to an apparatus for driving a plasma display panel in which an image being full of life can be displayed through expansion of contrast and a gray level can be expanded, and method thereof.

2. Background of the Related Art

A plasma display panel (hereinafter, referred to as a 'PDP') is adapted to display an image using a visible ray generated from phosphors when the phosphors are excited by ultraviolet generated during discharging of a gas. The PDP has advantages that it is thin in thickness and light in weight and can be made large with high definition compared to a cathode ray tube (CRT) that is the greater part of the display means.

FIG. 1 is a plan view schematically illustrating a conventional plasma display panel. FIG. 2 is a detailed perspective view illustrating the structure of a cell shown in FIG. 1.

Referring to FIG. 1 and FIG. 2, a three-electrode AC surface discharge type PDP includes scan electrodes Y1 to Yn and a sustain electrodes Z which are formed on an upper substrate 10, and address electrodes X1 to Xm formed on a lower substrate 18.

A discharge cells 1 of the PDP is formed every portion where the scan electrodes Y1 to Yn, the sustain electrodes Z and the address electrodes X1 to Xm intersect. Each of the scan electrodes Y1 to Yn and the sustain electrode Z includes a transparent electrodes 12, and a metal bus electrodes 11 having a line width narrower than that of the transparent electrodes 12 and formed at one edge sides of the transparent electrodes. The transparent electrodes 12 are typically formed using indium-tin-oxide (ITO) on the upper substrate 10. The metal bus electrodes 11 is typically formed using a metal on the transparent electrodes 12 and serves to reduce a voltage drop caused by the transparent electrodes 12 having high resistance.

An upper dielectric layer 13 and a protection film 14 are laminated on the upper substrate 10 in which the scan electrodes Y1 to Yn and the sustain electrode Z are formed parallel to each other. A wall charge generated upon plasma discharge is accumulated on the upper dielectric layer 13. The protection film 14 serves to protect the electrodes Y1 to Yn and Z and the upper dielectric layer 13 from sputtering generated upon the plasma discharging and to increase efficiency of secondary electron emission. The protection film 14 is typically formed using magnesium oxide (MgO).

The address electrodes X1 to Xm are formed on the lower substrate 18 in the direction in which they intersect the scan electrodes Y1 to Yn and the sustain electrode Z. A lower dielectric layer 17 and barrier ribs 15 are formed on the lower substrate 18. A phosphor layer 16 is formed on the lower dielectric layer 17 and the barrier ribs 15. The barrier ribs 15 have the form of stripe or lattice and physically separate discharge cells, thus shielding electrical and optical interference among neighboring discharge cells 1. The phosphor layer 16 is excited and light-emitted by ultraviolet rays generated upon plasma discharge to generate any one visible light of red, green and blue lights.

An inert mixed gas for a discharge such as He+Xe, Ne+Xe or He+Ne+Xe is injected into discharge spaces of the discharge cells defined between the upper substrate 10 and the barrier ribs 15 and the lower substrate 18 and the barrier ribs 15.

In this PDP, in order to implement the gray level of an image, one frame is divided into several sub fields having different numbers of emission and is then driven in time division. Each of the sub fields is divided into a reset period for generating discharging uniformly, an address period for selecting a discharge cell, and a sustain period for implementing the gray level depending on the number of discharging. For example, if a picture is to be represented using 256 gray levels, a frame period (16.67 ms) corresponding to 1/60 second is divided into eight sub fields. Also, each of the eight sub fields is divided into a reset period, an address period and a sustain period. In the above, the reset period and the address period of each of the sub fields are the same every sub fields, whereas the sustain period and the number of discharging thereof increase in the ratio of $2^n$(n=0, 1, 2, 3, 4, 5, 6, 7) in each of the sub fields in proportion to the number of a sustain pulse. Since the sustain period is different in each of the sub fields as such, it is possible to implement the gray level of an image.

FIG. 3 is a block diagram showing a conventional apparatus for driving a plasma display panel.

Referring to FIG. 3, the conventional apparatus for driving the PDP includes a gain control unit 32, an error diffusion unit 33 and a sub field mapping unit 34 all of which are connected between a first inverse gamma control unit 31A and a data alignment unit 35, and an APL calculator 36 connected between a second inverse gamma control unit 31B and a waveform generator 37.

The first and second inverse gamma correction units 31A and 31B perform inverse gamma correction for digital video data (RGB) received from an input line 30 to linearly convert brightness of a gray level value of an image signal.

The gain control unit 32 compensates for color temperature by adjusting an effective gain by each data of red, green and blue.

The error diffusion unit 33 finely controls a brightness value by diffusing quantization error of digital video data (RGB) received from the gain control unit 32 to adjacent cells. In the above, a gray level of data that passes through the error diffusion unit 33 is expanded finely.

The sub field mapping unit 34 serves to map the data received from the error diffusion unit 33 to a sub field pattern stored by the bit and supply the mapping data to the data alignment unit 35.

The data alignment unit 35 supplies digital video data received from the sub field mapping unit 34 to a data driving circuit of the panel 38. The data driving circuit is connected to data electrodes of the panel 38 and serves to latch data received from the data alignment unit 35 by one horizontal line and then supply the latched data to the data electrodes of the panel 38 in one horizontal period unit.

The APL calculator 36 calculates average brightness for digital video data (RGB) received from the second inverse gamma correction unit 31B in one screen unit, i.e., an average picture level (hereinafter, referred to as 'APL') and outputs information on the number of a sustain pulse corresponding to the calculated APL.

The waveform generator 37 generates a timing control signal in response to the information on the number of the sustain pulse from the APL calculator 36 and then supplies a timing control signal to a scan driving circuit and a sustain driving circuit (not shown). The scan driving circuit and the sustain driving circuit supplies the sustain pulse to the scan electrodes and the sustain electrodes of the panel 38 during the sustain period in response to the timing control signal received from the waveform generator 37.

Such a conventional PDP expands the gray level minutely using the error diffusion unit 33. If the gray level is expanded using the error diffusion unit 33 as such, there is a problem that the picture quality is lowered because an error diffusion pattern is shown in data of a predetermined pattern.

Furthermore, in order to display an image being more full of life in the conventional PDP, contrast of a gray level must be clear. In the conventional PDP, however, it is difficult to display an image being full of life since there is no method for expanding contrast of data.

SUMMARY OF THE INVENTION

Accordingly, the present invention has been made in view of the above problems, and it is an object of the present invention to provide an apparatus for driving a plasma display panel in which an image being full of life can be displayed through expansion of contrast and a gray level can be expanded, and method thereof.

To achieve the above object, according to the present invention, there is provided an apparatus for driving a plasma display panel, including: a frame memory for delaying an $i^{th}$ (i is a positive integer) frame data received from the outside by one frame, an inverse gamma control unit for performing inverse gamma correction for the $i^{th}$ frame data and a $(i-1)^{th}$ frame data received from the frame memory, a maximum gray level value output unit for extracting the highest gray level value from the data of the $i^{th}$ frame received from the inverse gamma control unit and outputting the highest gray level value of the $(i-1)^{th}$ frame stored therein, and a gain control unit for expanding the gray level of the $(i-1)^{th}$ frame data using the $(i-1)^{th}$ frame data received from the inverse gamma control unit and the $(i-1)^{th}$ highest gray level value received from the maximum gray level value output unit.

According to the present invention, there is provided a first method for driving a plasma display panel, including the steps of: performing inverse gamma correction for data received from the outside in the frame unit, extracting the highest gray level value of a frame from the inverse-gamma corrected data, and expanding the gray level of the data using the highest gray level value.

According to the present invention, there is provided a second method for driving a plasma display panel, including the steps of: delaying an $i^{th}$ frame data received from the outside by one frame and outputting the delayed $i^{th}$ frame data, performing inverse gamma correction for a $(i-1)^{th}$ frame data and the $i^{th}$ frame data that is delayed by one frame, extracting the highest gray level value from the $i^{th}$ frame data that experienced inverse gamma correction and outputting the highest gray level value of the stored $(i-1)^{th}$ frame data, and expanding the gray level of the $(i-1)^{th}$ frame data using the highest gray level value of the $(i-1)^{th}$ frame data.

According to the present invention, as a gray level of an input data is distributed over the whole gray level region, contrast can be expanded. It is thus possible to display an image being full of life. Furthermore, if a gray level of tan input data is expanded over the whole gray level region, contrast is increased. Moreover, in the present invention, when a gray level region is expanded, an error diffusion unit and/or a dithering unit are/is not used. It is therefore possible to prevent generation of noise (e.g. error diffusion pattern) due to the expansion of the gray level region.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
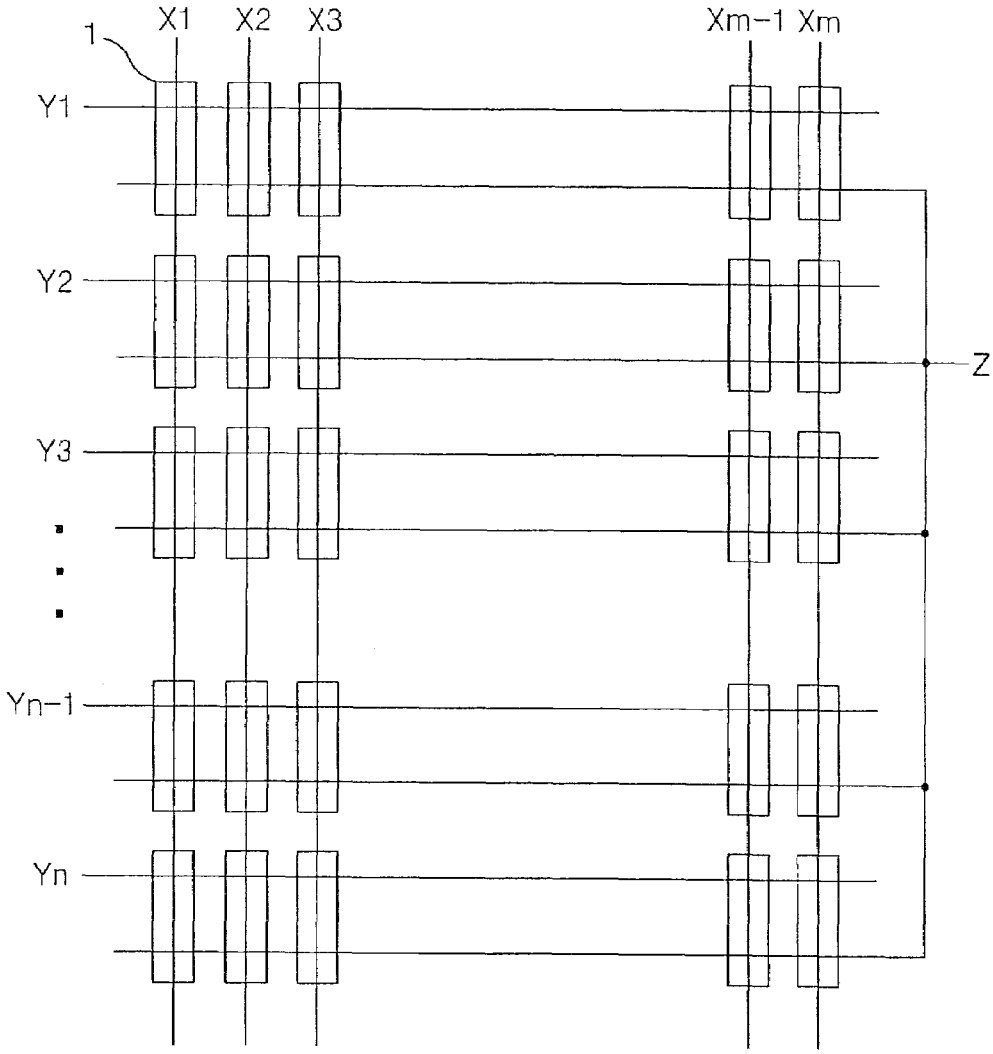
Fig. 1 PRIOR ART
FIG. 1 is a plan view schematically illustrating a conventional plasma display panel.
Figure 2:
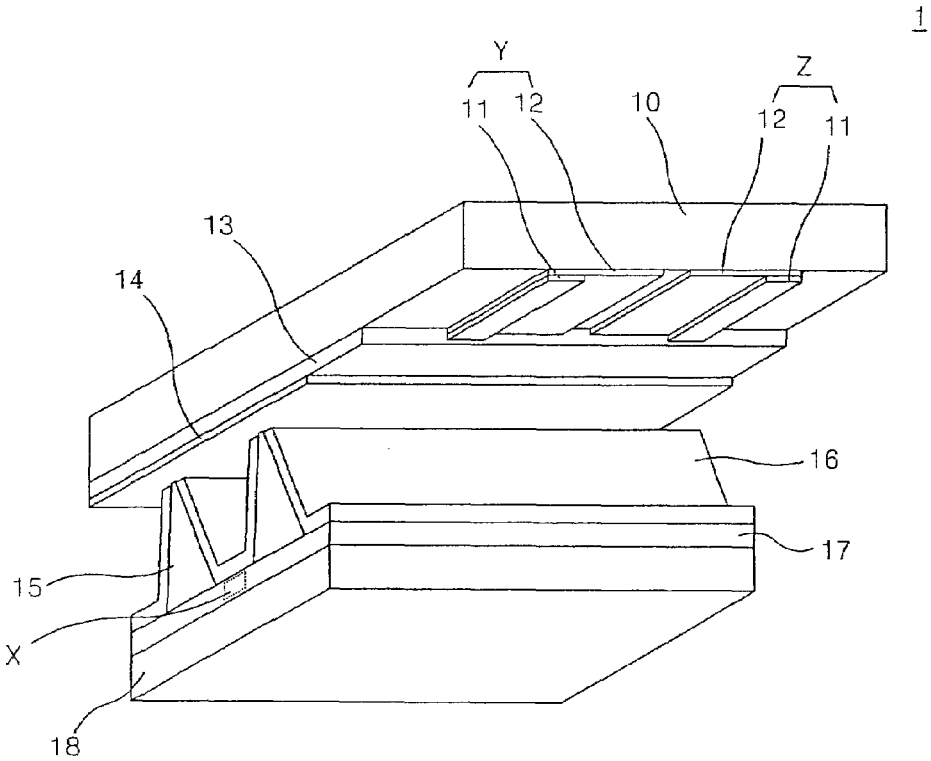
Fig. 2 PRIOR ART
FIG. 2 is a detailed perspective view illustrating the structure of a cell shown in FIG. 1.
Figure 3:
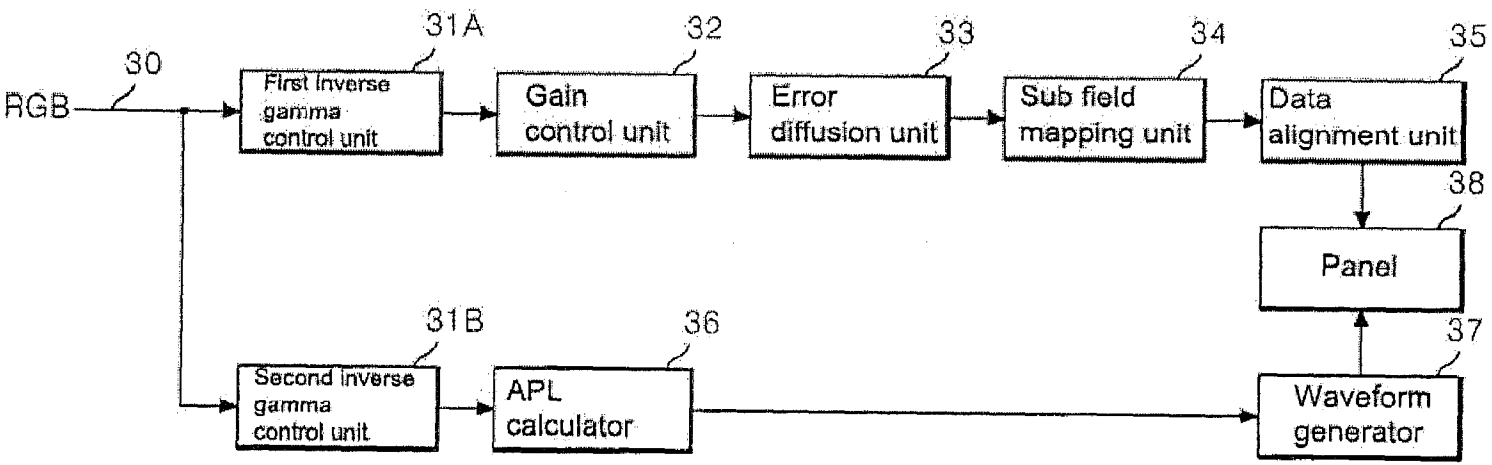
Fig. 3 PRIOR ART
FIG. 3 is a block diagram showing a conventional apparatus for driving a plasma display panel.

An apparatus for driving a plasma display panel according to the present invention, a first method for driving a plasma display panel and a second method for driving a plasma display panel will be described in a more detailed manner with reference to the accompanying drawings.

To achieve the above object, according to the present invention, there is provided an apparatus for driving a plasma display panel, including: a frame memory for delaying an $i^{th}$ (i is a positive integer) frame data received from the outside by one frame, an inverse gamma control unit for performing inverse gamma correction for the $i^{th}$ frame data and a $(i-1)^{th}$ frame data received from the frame memory, a maximum gray level value output unit for extracting the highest gray level value from the data of the $i^{th}$ frame received from the inverse gamma control unit and outputting the highest gray level value of the $(i-1)^{th}$ frame stored therein, and a gain control unit for expanding the gray level of the $(i-1)^{th}$ frame data using the $(i-1)^{th}$ frame data received from the inverse gamma control unit and the $(i-1)^{th}$ highest gray level value received from the maximum gray level value output unit.

The gain control unit expands the gray level so that the gray level of the data of the $(i-1)^{th}$ frame can be distributed over the whole gray level region.

The gain control unit expands the gray level of the $(i-1)^{th}$ frame using the following equation.

$$\text{Expansion gray level} = \text{MGL}/\text{FGL} \times \text{Input data} \qquad \text{Equation}$$

In the above, MGL is the highest gray level that can be expressed, FGL is the highest gray level value of a $(i-1)^{th}$ frame, and Input data is data of a $(i-1)^{th}$ frame inputted from an inverse gamma control unit.

The apparatus further includes an APL calculation unit for calculating average brightness in one screen unit using the data of the $i^{th}$ frame received from the inverse gamma control unit and outputting information on the number of a sustain pulse corresponding to the calculated average brightness, and a delay unit for delaying information on the number of the sustain pulse received from the APL calculation unit by one frame.

The apparatus further includes an additional inverse gamma control unit for performing inverse gamma correction for the $i^{th}$ frame data, an APL calculation unit for calculating average brightness in one screen unit using the data of the $i^{th}$ frame received from the additional inverse gamma control unit and outputting information on the number of a sustain pulse corresponding to the calculated average brightness, and a delay unit for delaying information on the number of the sustain pulse received from the APL calculation unit by one frame.

The apparatus further includes a sub field mapping unit for mapping the data of the $(i-1)^{th}$ frame whose gray level is expanded, which is received from the gain control unit, to a sub field pattern, a data alignment unit for aligning data received from the sub field mapping unit and supplying the data to a data driving circuit, and a waveform generator for generating a timing control signal corresponding to information on the number of the $(i-1)^{th}$ sustain pulse received from the delay unit and supplying the timing control signal to the scan driving circuit and the sustain driving circuit.

According to the present invention, there is provided a first method for driving a plasma display panel, including the steps of: performing inverse gamma correction for data received from the outside in the frame unit, extracting the highest gray level value of a frame from the inverse-gamma corrected data, and expanding the gray level of the data using the highest gray level value.

In the step of expanding the gray level of the data, the gray level is expanded using the following Equation.

$$\text{Expansion gray level} = \text{MGL}/\text{FGL} \times \text{Input data} \qquad \text{Equation}$$

In the above, MGL is the highest gray level that can be expressed, FGL is the highest gray level value of a $(i-1)^{th}$ frame, and Input data is data of a $(i-1)^{th}$ frame inputted from an inverse gamma control unit.

The method further includes the step of calculating average brightness in one screen unit using the inverse-gamma corrected frame data and calculating the number of the sustain pulse corresponding to the calculated average brightness.

According to the present invention, there is provided a second method for driving a plasma display panel, including the steps of: delaying an $i^{th}$ frame data received from the outside by one frame and outputting the delayed $i^{th}$ frame data, performing inverse gamma correction for a $(i-1)^{th}$ frame data and the $i^{th}$ frame data that is delayed by one frame, extracting the highest gray level value from the $i^{th}$ frame data that experienced inverse gamma correction and outputting the highest gray level value of the stored $(i-1)^{th}$ frame data, and expanding the gray level of the $(i-1)^{th}$ frame data using the highest gray level value of the $(i-1)^{th}$ frame data.

In the step of expanding the gray level, the gray level is expanded using the following Equation.

$$\text{Expansion gray level} = \text{MGL}/\text{FGL} \times \text{Input data} \qquad \text{Equation}$$

In the above, MGL is the highest gray level that can be expressed, FGL is the highest gray level value of a $(i-1)^{th}$ frame, and Input data is data of a $(i-1)^{th}$ frame inputted from an inverse gamma control unit.

The method further includes the step of calculating average brightness in one screen unit using the inverse-gamma corrected $i^{th}$ frame data and calculating the number of the sustain pulse corresponding to the calculated average brightness, and delaying information on the number of the calculated sustain pulse by one frame.

The method further includes the step of displaying an image using the $(i-1)^{th}$ frame data whose gray level is expanded and information on the number of the $(i-1)^{th}$ sustain pulse that is delayed by one frame.

Figure 4:
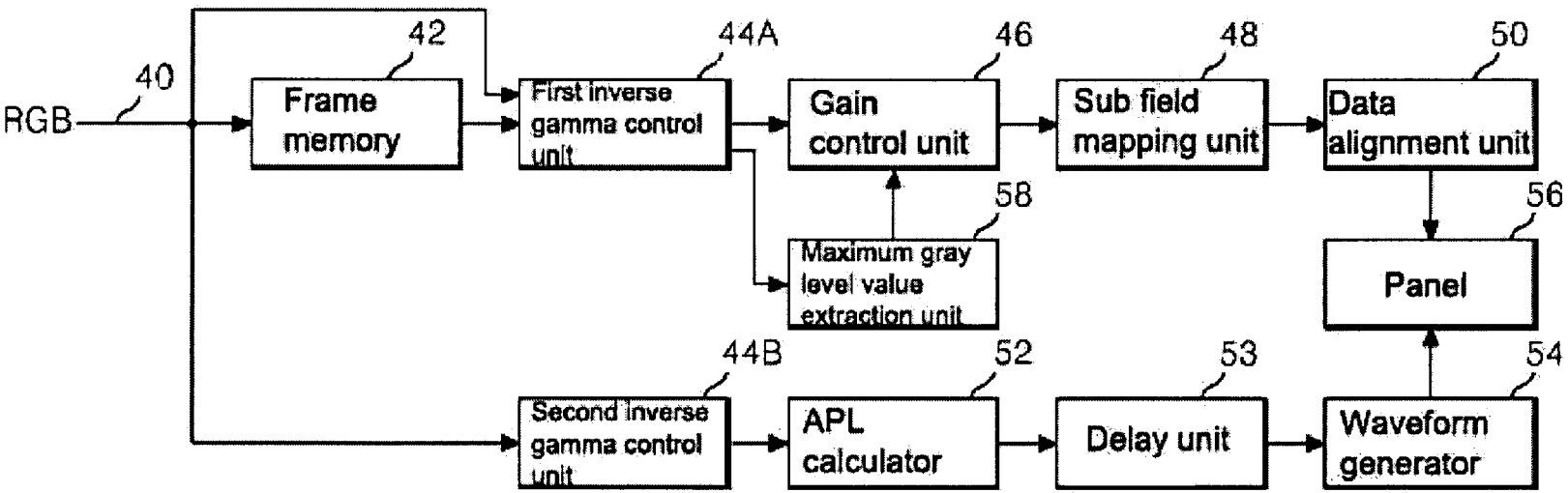
FIG. 4 is a block diagram showing an apparatus for driving a plasma display panel according to an embodiment of the present invention.

FIG. 4 is a block diagram showing an apparatus for driving a plasma display panel according to an embodiment of the present invention.

Referring to FIG. 4, the apparatus for driving the PDP according to an embodiment of the present invention includes a first inverse gamma control unit 44A, a gain control unit 46 and a sub field mapping unit 48 all of which are connected between a frame memory 42 and a data alignment unit 50; an APL calculator 52 and the delay unit 53 both of which are connected between a second inverse gamma control unit 44B and a waveform generator 54; and a maximum gray level value extraction unit 58 connected between the first inverse gamma control unit 44A and the gain control unit 46.

The frame memory 42 stores data for one frame and outputs the data.

The first inverse gamma control unit 44A performs inverse gamma correction for digital video data (RGB) received from the input line 40 and the frame memory 42 to linearly convert brightness for a gray level value of an image signal. In the above, the first inverse gamma control unit 44A receives data of an i (i is a positive integer)$^{th}$ frame from the input line 40 and receives data of a $n(i-1)^{th}$ frame from the frame memory 42.

The maximum gray level value extraction unit 58 receives the data of the $i^{th}$ frame from the first inverse gamma control unit 44A. In the above, the maximum gray level value extraction unit 58 extracts the maximum gray level value from the $i^{th}$ frame data received thereto. Meanwhile, the maximum gray level value extraction unit 58 supplies the maximum gray level value of the $(i-1)^{th}$ frame data that is temporarily stored to the gain control unit 46 when the $i^{th}$ frame data is inputted.

The gain control unit 46 receives the data of the $(i-1)^{th}$ frame from the first inverse gamma control unit 44A. The gain control unit 46 receives the maximum gray level value of the $(i-1)^{th}$ frame from the maximum gray level value extraction unit 58. In the above, the gain control unit 46 expands a gray level region of the data of the $(i-1)^{th}$ frame according to the following Equation 1.

$$\text{Expansion gray level} = \text{maximum gray level that can be represented}/\text{maximum gray level value of frame} \times \text{gray level value of input data} \qquad \text{Equation 1}$$

The maximum gray level that can be represented in Equation refers to a maximum gray level value that can be represented in a PDP currently. For example, if 256 gray levels can be represented in a PDP, the maximum gray level that can be represented is set to '255'. The maximum gray level value of a frame refers to the maximum gray level value of a frame supplied from the maximum gray level value extraction unit 58. Furthermore, the gray level value of the input data refers to the gray level value of data that is received from the first inverse gamma control unit 44A.

For instance, if the maximum gray level of the $(i-1)^{th}$ frame is "128" and a gray level value of data that is currently being inputted is "128" (i.e., the maximum gray level), the gray level of "128" is expanded to "255" in the gain control unit 46. Also, if a gray level value of data that is currently being inputted is "65", the gray level of "65" is expanded to "129.49" in the gain control unit 46. In the above, the gain control unit 46 makes the gray level calculated according to Equation 1 integer (a decimal is removed) using rounding off to the nearest integer 129, descending 129 or ascending 130 method.

Figure 5:
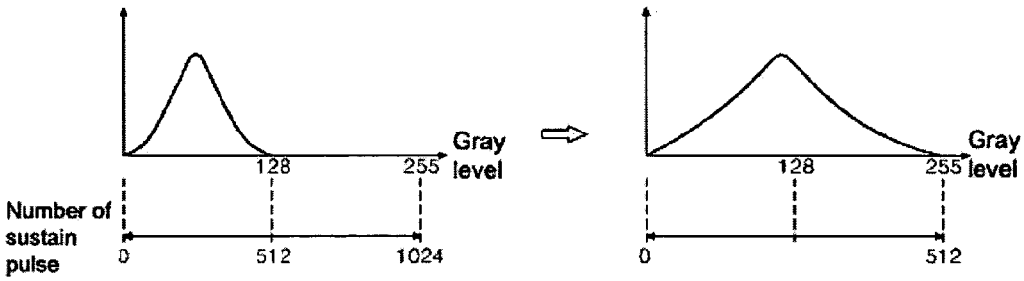
FIG. 5 shows the operating procedure of a gain control unit shown in FIG. 4.

As described above, the gain control unit 46 distributes the data of the $(i-1)^{th}$ frame received from the inverse gamma control unit 44A over the whole gray level region according to Equation 1. In other words, the gain control unit 46 expands the gray level of the input data distributed in some regions to the whole gray level regions 0 to 255, as shown in FIG. 5. If the data is expanded to the whole gray level region as such, contrast is expanded. That is, since the gray level region of data distributed over some regions is expanded to the whole gray level regions 0 to 255, brightness and darkness among data are shown clearly (i.e., contrast is expanded). An image being full of life can be represented.

The sub field mapping unit 48 maps the data of the $(i-1)^{th}$ frame received from the gain control unit 46 to a sub field pattern that is stored by each bit in advance and supplies the stored mapping data to the data alignment unit 50.

The data alignment unit 50 supplies the digital video data received from the sub field mapping unit 48 to a data driving circuit of the panel 56. The data driving circuit is connected to data electrodes of the panel 56, and latches the data received from the data alignment unit 50 by one horizontal line and supplies the latched data to the data electrodes of the panel 56 in one horizontal period unit.

The second inverse gamma control unit 44B performs inverse gamma correction for the digital video data RGB of the $i^{th}$ frame received from the input line 40 to linearly convert brightness for a gray level value of an image signal.

The APL calculator 52 calculates average brightness, i.e., APL (Average Picture Level) in one screen unit for the digital video data RGB of the $i^{th}$ frame that is received from the second inverse gamma control unit 44B and outputs information on th number of a sustain pulse corresponding to the calculated APL. (The APL calculator 52 can receive the digital video data of the $i^{th}$ frame from the first inverse gamma correction unit 44A. In this case, the second inverse gamma control unit 44B is omitted.) At this time, the APL calculator 52 calculates the APL using information on a gray level of original data not an expanded gray level. Therefore, the number of the sustain pulse can be set in various manners corresponding to the original data.

The delay unit 53 delays information on the number of the sustain pulse that is received from the APL calculator 52 by one frame. Therefore, when information on the number of a sustain pulse corresponding to the $i^{th}$ frame is inputted to the delay unit 53, information on the number of the sustain pulse corresponding to $(i-1)^{th}$ frame is supplied to the waveform generator 54.

The waveform generator 54 generates a timing control signal in response to information on the number of the sustain pulse of the $(i-1)^{th}$ frame and supplies a timing control signal to the scan driving circuit and the sustain driving circuit (not shown). The scan driving circuit and the sustain driving circuit supply the sustain pulse to the scan electrodes and the sustain electrodes of the panel 56 during the sustain period in response to the timing control signal received from the waveform generator 54.

The panel 56 displays a predetermined image corresponding to the $(i-1)^{th}$ frame by controlling the data driving circuit, the scan driving circuit and the sustain driving circuit. In the above, the image displayed on the panel 56 is determined by data of an expanded gray level region. Accordingly, an image being full of life can be displayed on the panel 56.

As described above, according to the present invention, as a gray level of an input data is distributed over the whole gray level region, contrast can be expanded. It is thus possible to display an image being full of life. Furthermore, if a gray level of tan input data is expanded over the whole gray level region, contrast is increased. Moreover, in the present invention, when a gray level region is expanded, an error diffusion unit and/or a dithering unit are/is not used. It is therefore possible to prevent generation of noise (e.g. error diffusion pattern) due to the expansion of the gray level region.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for driving a plasma display panel, comprising:

a frame memory for storing $(i-1)^{th}$ (i is a positive integer) frame data;

an inverse gamma control unit, coupled to the frame memory, for performing inverse gamma correction for $i^{th}$ frame data and the $(i-1)^{th}$ frame data received from the frame memory;

a maximum gray level value output unit for extracting and outputting highest gray level value of the $(i-1)^{th}$ frame data; and a gain control unit for expanding the gray level of the $(i-1)^{th}$ frame data based on the following equation:

$$\text{Expansion Gray Level} = MGL/FGL \times \text{Input Data}$$

wherein MGL is a highest gray level that can be expressed, FGL is the highest gray level value of the $(i-1)^{th}$ frame data, and Input Data corresponds to a gray level of the $(i-1)^{th}$ frame data input from the inverse gamma control unit.

2. The apparatus as claimed in claim 1, wherein the gain control unit expands the gray level of the $(i-1)^{th}$ frame data so that the gray level of the $(i-1)^{th}$ frame data is distributed over the MGL region.

3. An apparatus for driving a plasma display panel, comprising:

a frame memory for storing $(i-1)^{th}$ (i is a positive integer) frame data;

an inverse gamma control unit, coupled to the frame memory, for performing inverse gamma correction for $i^{th}$ frame data and the $(i-1)^{th}$ frame data received from the frame memory;

a maximum gray level value output unit for extracting and outputting a highest gray level value of the $(i-1)^{th}$ frame data;

a gain control unit for expanding the gray level of the $(i-1)^{th}$ frame data based on the highest gray level value of the $(i-1)^{th}$ frame data received from the maximum gray level value output unit, the apparatus further comprising:

an APL calculation unit for calculating average brightness based on frame data that has been inverse gamma corrected, and for outputting information on a number of sustain pulses corresponding to the calculated average brightness; and a delay unit for delaying information on the number of the sustain pulses received from the APL calculation unit, wherein the panel displays an image based on the expanded gray level of $(i-1)^{th}$ frame data and a timing control signal generated in response to the information on the number of sustain pulses output from the delay unit.

4. The apparatus as claimed in claim 3, further comprising:

a sub field mapping unit for mapping the data of the $(i-1)^{th}$ frame data, whose gray level is expanded and is received from the gain control unit, to a sub field pattern;

a data alignment unit for aligning the data received from the sub field mapping unit and supplying the data to a data driving circuit; and a waveform generator for generating a timing control signal corresponding to information on the number of the sustain pulses received from the delay unit and supplying the timing control signal to a scan driving circuit and a sustain driving circuit.

5. The apparatus as claimed in claim 3, wherein the APL calculation unit calculates the average brightness based on the output of another inverse gamma correction unit.

6. An apparatus for driving a plasma display panel, comprising:

a frame memory for storing $(i-1)^{th}$ (i is a positive integer) frame data;

an inverse gamma control unit, coupled to the frame memory, for performing inverse gamma correction for $i^{th}$ frame data and the $(i-1)^{th}$ frame data received from the frame memory;

a maximum gray level value output unit for extracting and outputting a highest gray level value of the $(i-1)^{th}$ frame data;

a gain control unit for expanding the gray level of the $(i-1)^{th}$ frame data based on the highest gray level value of the $(i-1)^{th}$ frame data received from the maximum gray level value output unit, the apparatus further comprising:

an additional inverse gamma control unit for performing inverse gamma correction for frame data including the $i^{th}$ frame data and the $(i-1)^{th}$ frame data;

an APL calculation unit for calculating average brightness based on $i^{th}$ frame data received from the additional inverse gamma control unit and outputting information on a number of a sustain pulses corresponding to the calculated average brightness; and a delay unit for delaying information on the number of the sustain pulse received from the APL calculation unit, wherein the panel displays an image based on the expanded gray level of $(i-1)^{th}$ frame data and a timing control signal generated in response to the information on the number of sustain pulses output from the delay unit.

7. The apparatus as claimed in claim 6, wherein the APL calculation unit calculates the average brightness based on the output of another inverse gamma correction unit.

8. A method for driving a plasma display panel, comprising:

performing inverse gamma correction for data received in a frame unit;

extracting a highest gray level value of the inverse-gamma corrected data; and expanding a gray level of the data based on the following equation:

$$\text{Expansion Gray Level}=\text{MGL}/\text{FGL}\times\text{Input Data}$$

wherein MGL is a highest gray level that can be expressed, FGL is the highest gray level value of the data, and Input Data corresponds to a gray level of the data that has been inverse gamma corrected.

9. The method as claimed in claim 8, further comprising:

calculating average brightness of the inverse-gamma corrected frame data; and calculating the number of sustain pulses corresponding to the calculated average brightness.

10. A method for driving a plasma display panel, comprising:

delaying and outputting frame data received;

performing inverse gamma correction for the frame data;

extracting a highest gray level value from the frame data that experienced inverse gamma correction and outputting the highest gray level value; and expanding a gray level of the frame data based on the following equation:

$$\text{Expansion Gray Level}=\text{MGL}/\text{FGL}\times\text{Input Data}$$

wherein MGL is a highest gray level that can be expressed, FGL is the highest gray level value of the frame data, and Input Data corresponds to a gray level of the frame data that has been inverse gamma corrected.

11. The method as claimed in claim 10, further comprising: calculating average brightness based on inverse-gamma corrected frame data; calculating a number of sustain pulses corresponding to the calculated average brightness; and delaying information on the number of the calculated sustain pulses.

12. The method as claimed in claim 11, further comprising displaying an image based on the frame data whose gray level is expanded and information on the number of the calculated sustain pulses.

* * * * *